US006729573B2

(12) United States Patent
Burri et al.

(10) Patent No.: US 6,729,573 B2
(45) Date of Patent: May 4, 2004

(54) ROLL CHANGER AND PROCESS FOR AUTOMATIC ROLL CHANGE DURING STOPPAGE

(75) Inventors: Daniel Burri, Konolfingen (CH); Hans Moser, Utzigen (CH)

(73) Assignee: Maschinenfabrik Wifag, Bern (CH)

( * ) Notice: Subject to any disclaimer, the term of this patent is extended or adjusted under 35 U.S.C. 154(b) by 0 days.

(21) Appl. No.: 10/247,133

(22) Filed: Sep. 19, 2002

(65) Prior Publication Data

US 2003/0057315 A1 Mar. 27, 2003

(30) Foreign Application Priority Data

Sep. 21, 2001 (DE) ..... P 101 46 631

(51) Int. Cl.[7] ..... B65H 19/18
(52) U.S. Cl. ..... 242/555.5
(58) Field of Search ..... 242/555.5, 555.6, 242/555.3, 554.4, 554.5, 527.3, 527.4, 532

(56) References Cited

U.S. PATENT DOCUMENTS 3,279,716 A * 10/1966 Huck ..... 242/527.4
3,326,486 A * 6/1967 Blessing ..... 242/555.5
3,391,877 A * 7/1968 Angell et al. ..... 242/554.4
4,543,152 A * 9/1985 Nozaka ..... 242/554.5
5,133,511 A * 7/1992 Mack et al. ..... 242/555.5
5,152,472 A * 10/1992 Spang et al. ..... 242/555.6
5,360,181 A * 11/1994 Hayashi et al. ..... 242/555.6
6,241,179 B1 * 6/2001 Hachiya et al. ..... 242/555.5

FOREIGN PATENT DOCUMENTS

DE 34 40 107 5/1986

* cited by examiner

*Primary Examiner*—William A. Rivera
(74) *Attorney, Agent, or Firm*—McGlew and Tuttle, P.C.

(57) ABSTRACT

A roll changer for a web-treating or -processing machine is set up for winding off a working web (A) to be treated or processed from a working roll (A) and for connecting a reserve web (V) from a reserve roll (R2) to the working web (A). The roll changer includes a first mount (1, 4) for the working roll (R1) and a second mount (2, 5) for the reserve roll (R2). A connecting device (10) connects the reserve web (V) to the working web (A). A holding device (21) is arranged downstream of the connecting device (10) along the web for fixing the working web (A). A pulling device (16), is arranged in a path of the working web (A) between the connecting device (10) and the holding device (21) and is set up to pull the working web (A) from the working roll (R1) during the stoppage of the working roll (R1).

15 Claims, 5 Drawing Sheets

ROLL CHANGER AND PROCESS FOR AUTOMATIC ROLL CHANGE DURING STOPPAGE

FIELD OF THE INVENTION

The present invention pertains to a roll changer for a web-treating or -processing machine, which is set up for a roll change during the stoppage of the roll changer. The present invention also pertains to an automatic roll change in such a machine, in which a web to be replaced is pulled into the machine, but is not in production.

BACKGROUND OF THE INVENTION

Web-fed printing presses, which are preferred examples of web-treating machines in the sense of the present invention, usually have roll changers which are able to perform a so-called flying roll change. During a flying roll change, a reserve web is joined fully automatically with a working web being wound off from a working roll in the roll changer during running production and is connected to the working web. The reserve web is wound off in the roll changer from a reserve roll. The working web is cut off, and the old working roll is removed from the roll changer either likewise fully automatically or manually and replaced with a new reserve roll. The reserve web attached to the working web is the new working web.

Even though roll changers that are set up for flying roll change are the standard at least in large newspaper rotary printing presses, such a roll change causes problems during the stoppage of the roll changer. In particular, no roll changers are known which are set up for both flying roll change and for fully automatic roll change during the stoppage of the roll changer.

SUMMARY OF THE INVENTION

Therefore, the object of the present invention is to make possible automatic roll change during the stoppage of the roll changer, preferably in a roll changer with which flying roll change can be performed.

The present invention is based on a roll changer for a web-treating or -processing machine, which is set up for unwinding a working web to be treated from a working roll, for joining a reserve web to the working web and for connecting the two webs to one another. A preferred example of a web-treating machine is a web-fed rotary printing press, preferably an offset printing press for newspaper printing, especially for printing large editions of newspapers. However, the machine may also be a web-treating or -processing machine for plastics or metals and, in principle, for any web-shaped material, e.g., a plastic film, a metal foil, but especially preferably paper. The web that has already been pulled into the machine and is to be replaced with the reserve web, e.g., after it had been used up, is called the working web in the sense of the present invention.

The roll changer has a first mount for the working roll and a second mount for the reserve roll. The mounts are movable in the roll changer preferably such that they can be moved alternatingly into a working position and into a changing position. The working position advantageously also forms a joining position, which is a bonding position in the case of joining by bonding. The mounts are preferably formed by roll arms, which can be alternatingly pivoted into the working position and into the changing position. The roll changer comprises, furthermore, a connecting means for connecting the reserve web to the working web. The connecting means is preferably designed as a bonding means in order to establish a bonded connection between the working web and the reserve web. This is the currently common connection technique for paper webs in web-fed rotary printing. However, the connecting means may also be formed by a welding means in the case of machines for treating or processing plastic films as well as in machines for treating or processing metal webs. However, other suitable connection techniques shall not be excluded, either, not even for paper webs.

The roll changer comprises, furthermore, a holding means, which is arranged behind the connecting means in the direction of feed of the working web, i.e., downstream of the connecting means along the web. The holding means is designed such that it can fix, preferably completely block the working web in relation to the direction of feed. The fixation preferably takes place exclusively by frictional engagement, especially preferably by clamping the working web.

Finally, the roll changer comprises a pulling means for the working web. The pulling means is arranged in the path of the web between the connecting means and the holding means and is set up or designed such that it can pull the working web from the working roll. The pulling off from the working roll takes place either entirely without support by a motor or with support by a motor or even against a braking force, which may be generated by a drive motor or an additional brake. In any case, an advantageous web tension is generated and maintained during the pulling off by means of the pulling means, optionally in cooperation with a rotating drive of the working roll or a brake for the working roll. Even though the pulling means may be a pulling means with which the web is also fed during running production, the web is preferably fed by means of the pulling means only during the stoppage of the roll changer by an amount that must, of course, be large enough to be able to establish the connection of the reserve web to the working web and to perform the automatic roll change with the working web fixed. If the pulling means also feeds the web during running production, this preferably takes place only temporarily.

An especially elegant solution is the use of a tensioning means as the pulling means, which is used to compensate variations in the web tension during the running production of the machine. Prior-art web tensioning means, e.g., pivotably or linearly movably mounted dancing rollers and equivalent roll means, around which the web is wrapped and which regulate the web tension due to their own movement at right angles to their longitudinal axis by changing the length of the path of the web, are suitable for this. The tensioning element wrapped around by the web, a cylindrical body in the case of a roller or optionally also only a simple rod or the plurality of cylindrical bodies in the case of a roll means, is mounted movably at right angles to its longitudinal axis against the force of elasticity of a restoring element. In the variant of a pulling means according to the present invention, the tensioning element is, furthermore, coupled with a drive bringing about this transverse movement. The drive may be, e.g., an electric motor or a fluid drive, especially a piston-and-cylinder unit. Such a pulling means known from tensioning means may also be used only as a pulling means and does not have to be used as a tensioning means. It is consequently not absolutely necessary for a restoring element for generating a restoring force of elasticity to be present.

The holding means may be formed, in principle, by one or more treating or processing means of the machine, which follows/follow the roll changer in the path of the working web and which is/are considered to belong to the roll changer in such a design of the holding means for the purposes of the present invention. However, the holding means is preferably formed on the path of the working web in front of the first treating or processing means, which follows the pulling means according to the present invention in order to obtain a short web path between the pulling means and the holding means. It shall be ensured by the holding means that the stopped working web can indeed be pulled off from the working roll by means of the pulling means by a sufficient amount. The working web must be pulled out by at least such a length that the connection to the working web can be established. The beginning of the web of the reserve roll should preferably also be separated from the reserve roll by the pulling out. The holding means must therefore fix the web at least in the sense that the working web is not pulled out of the machine in the direction of the roll changer by means of the pulling means, while pulling off or pulling out of the working web from the working roll does not take place to a sufficient extent.

In a web-fed rotary printing press, the holding means may be formed especially by a pulling roller or a plurality of pulling rollers, which is/are arranged in the way of the working web in front of the first printing mechanism, especially by a draw-in mechanism for the printing mechanism or for a plurality of printing mechanisms. This also applies analogously to the corresponding means in other web-treating or -processing machines. For roll change during stoppage, such a pulling roller or the plurality of pulling rollers is/are fixed, i.e., the pulling roller or pulling rollers can be preferably blocked. If the coefficient of friction between the web and such a pulling roller or a plurality of pulling rollers is already sufficient for fixing the web, the holding means according to the present invention may be formed by a pulling means that is already present. However, a pressing element is arranged adjacent to a pulling element following the pulling means according to the present invention most closely such that the pressing element can be pressed against the pulling element in order to clamp and fix the web between the pulling element and the pressing element such that the web cannot be pulled in in the rearward direction by the action of the pulling means according to the present invention.

In a process according to the present invention for the automatic roll change during stoppage in a web-treating machine, at least the following operations are performed. The reserve roll is moved into a joining position. The reserve web, which is wound up into the reserve roll, is located in the joining position in parallel to and at a spaced location from the working web pulled into the machine, so that the reserve web will exactly overlap the working web in the case of its winding off. The working web is pressed in the joining position of the reserve roll to a beginning of the web of an outermost web layer of the reserve roll and is connected to this beginning of the web. The working web is fixed downstream of the beginning of the web of the reserve roll, preferably clamped such that it does not move or it does not move to a practically relevant extent in the longitudinal direction of the web under the effect of the pulling forces acting for the roll change at the site of the fixation. The fixation is preferably performed before the connection is established. The fixation may be performed after the working web is pressed onto the reserve roll or preferably before the pressing on. The case in which the working web had already been fixed before the reserve roll assumed the joining position shall not be excluded, either. After the connection is established, a pulling force is applied to the fixed working web at a point between the beginning of the web of the reserve roll and the point of fixation, and the working web is pulled from the working roll as a result. Finally, the working web is severed at a point between the working roll and the beginning of the web of the reserve roll.

The unwinding of the working web from the working roll is controlled during the pulling out operation from the working roll, e.g., by the working roll being driven by a rotating drive motor in a manner coordinated with the pulling-out speed of the pulling means according to the present invention. Instead of by a preferably regulated drive of the working roll, which is coordinated in this sense, the controlled unwinding may advantageously also be brought about by the controlled braking of the working roll in order to set a favorable web tension for the pulling out.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
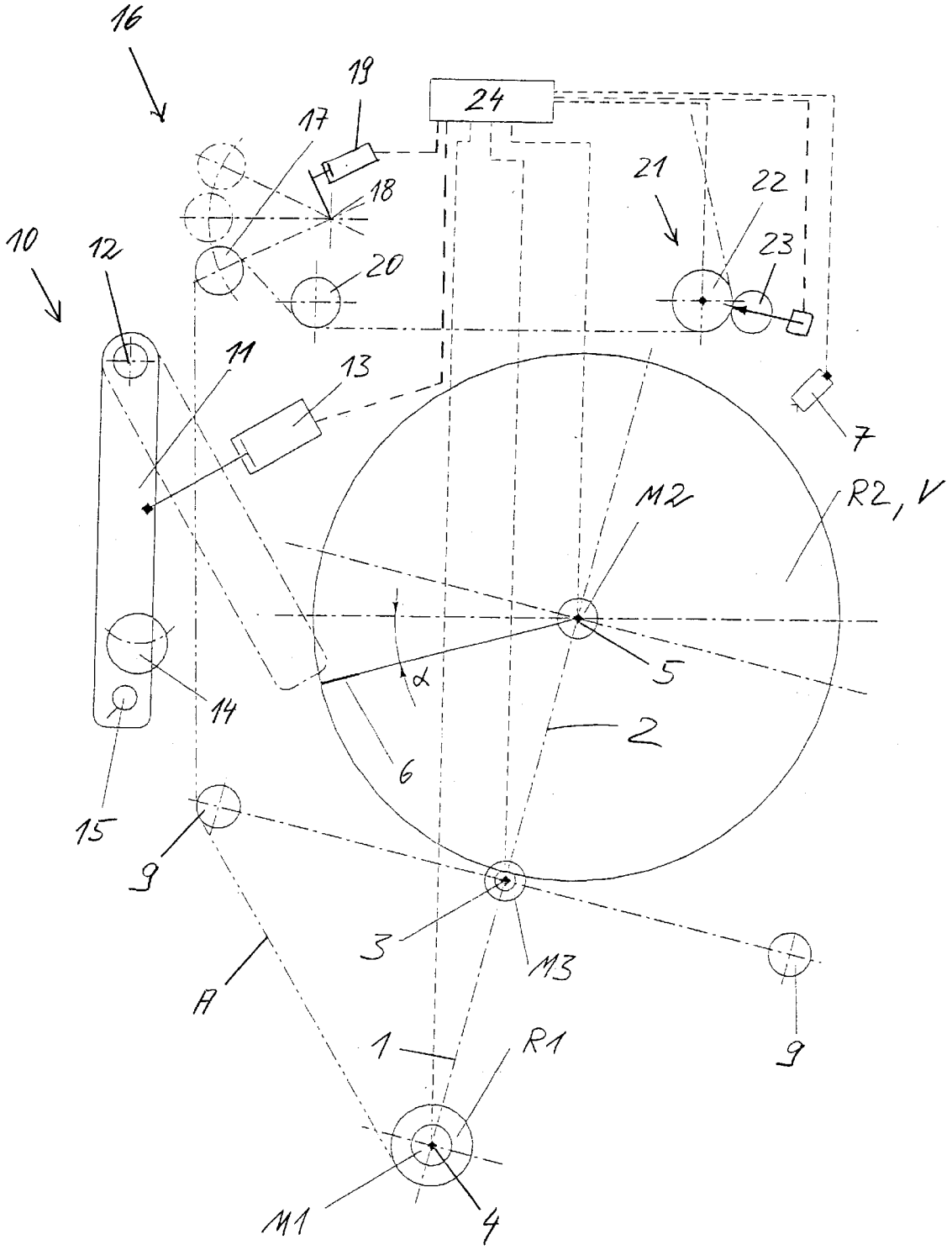
FIG. 1 is a schematic view showing a roll changer with a used-up working roll and a new reserve roll before the roll change.

Referring to the drawings in particular, the figures show a roll changer for web-web rotary printing presses, which is set up for receiving two paper rolls R1 and R2. It has a first roll arm 1, which holds the roll R1 rotatably around an axis of rotation 4. The roll R1 forms a working roll, from which a working web A pulled into the printing press is wound off. The other roll R2 is held on a second roll arm 2, likewise rotatably around an axis of rotation 5 formed by this roll arm 2. The second roll R2 is a reserve roll of a reserve web V, which is to replace the almost used-up working roll R1. A motor M1 forms a rotating drive for the working roll R1, and it drives the working roll R1 rotatably around the axis of rotation 4 during the operation of the press. An identical motor M2 forms a rotating drive for the reserve roll R2 to rotatingly drive the reserve roll R2 around its axis of rotation 5.

The two roll arms 1 and 2 form swivel arms arranged flush around a common pivot axis 3. Another motor M3 forms a pivoting drive for pivoting the roll arms 1 and 2 around the pivot axis 3. Due to the counterclockwise pivoting movement, the roll arm 2 can be pivoted into the pivoted position shown in the figures for the roll arm 1. The roll arm 1 is correspondingly pivoted during such a pivoting movement into the pivoted position shown in the figures for the roll arm 2. Furthermore, two deflecting rollers 9 can be pivoted on swivel arms around the pivot axis 3. The swivel arms for the deflecting rollers 9 are connected to the roll arms 1 and 2, rotating in unison with them, and form a cross with same.

In addition to the mounting means described for the rolls R1 and R2, the roll changer comprises a connecting means 10, a pulling means 16 and a holding means 21 along a web path formed for the working web A.

The connecting means 10 is designed as a bonding means. It comprises as the joining element a bonding roller 14, which is mounted rotatably on a swivel arm 11 opposite the reserve roll R2. The swivel arm 11 is pivotable around a pivot axis 12, which is directed in parallel to the axis of rotation 5 of the reserve roll R2. The axis of rotation of the bonding roller 14 is also directed in parallel to the axis of rotation 5. As is indicated in FIG. 1, the bonding roller 14 can be pressed onto the reserve roll R2 by means of the pivoting movement around the pivot axis 12. The pivoting movement toward the reserve roll R2 and away from the reserve roll R2 is brought about by means of a pivoting drive 13, which is formed by a piston-and-cylinder unit. The working web A is passed through between the reserve roll R2 and the bonding roller 14 in the position of the working roll R1 shown in the figures.

The pulling means 16 is arranged in the path of the working web A directly behind the connecting means 10. The pulling means 16 comprises a cylindrical body 17, which is mounted on a swivel arm pivotably around a pivot axis 18. The cylindrical body 17 is mounted freely rotatably around its longitudinal axis and is formed by a roller body having the width of the web in the exemplary embodiment. The working web A wraps around the cylindrical body 17 with an angle of wrap greater than 90° and is deflected downstream along the web by the cylindrical body 17 around a deflecting roller 20. The working web A is tensioned freely between the deflecting roller 9 of the roll mount and the cylindrical body 17, i.e., there are no additional deflecting elements in this section of the path of the web. Only the connecting means 10 acts on the working web A in this section of the web to establish the joined connection. However, additional deflecting bodies may be arranged, in principle, in front of and/or behind the connecting means 10.

The cylindrical body 17 preferably forms, as in the exemplary embodiment, a prior-art dancing roller, which is used to compensate variations in the web tension. The cylindrical body 17 is correspondingly pivotable around the pivot axis 18 against the force of elasticity of a restoring element, e.g., a compression spring or a fluid-pressurized cylinder, and the cylindrical body 17 is moved by the wrapped working web A against the force of the restoring element because of the web tension. The pulling means 16 is equipped with a drive 19, which is designed as a pivoting drive corresponding to the dancing roller arrangement selected as an example. The drive 19 is preferably a piston-and-cylinder unit and is used to pivot the cylindrical body 17 around the pivot axis 18. The figures show a middle normal or desired position and two positions of the cylindrical body 17 located on both sides of the middle position.

The tensioning and pulling means 16 thus formed is followed in the path of the working web A by the holding means 21. The holding means 21 comprises a rotatingly driven cylindrical body 22, which is wrapped by the working web A. In the exemplary embodiment, the cylindrical body 22 is, as is preferred, a pulling roller. The working web A is tensioned freely between the deflecting roller 20 of the tensioning and pulling means 16 and the pulling roller 22, i.e., no additional elements act on the working web A in this section of the web. However, deflecting bodies may, in principle, be arranged in between. The holding means 21 is preferably formed by an already existing pulling means, which is arranged between the tensioning and pulling means 16 and the printing mechanism of the machine that is located most closely. If such a draw-in mechanism has a plurality of pulling rollers, the pulling roller located closest in the web path of the tensioning and pulling means 16 preferably forms the cylindrical body 22. To ensure that the working web A can be fixed by the holding means 21 when needed such that it does not move under the effect of the pulling forces acting during a roll change, a blocking element, which is formed by a clamping element 23 and which can be engaged with or disengaged from the cylindrical body 22 and can be moved away from the cylindrical body 22, e.g., by means of a pivoting mount of the clamping element 23, is arranged opposite the cylindrical body 22. If the cylindrical body 22 is designed as a roller, the clamping element 23 is preferably likewise formed by a roller body, which is, however, not rotatable around its own longitudinal axis for the purpose of fixing the working web A.

Finally, the roll changer also comprises a sensor 7 directed toward the surface of the reserve roll R2. The sensor 7 is used to detect a bonding site 6, at which the beginning of the reserve web V is bonded to a next web layer of the reserve roll R2.

The signals of the sensor 7 are sent to a control means 24. The control means 24 is used to control and preferably also to regulate the drives M1, M2, M3, 13 and 19 of a rotating drive for the cylindrical body 22 and of a drive for engaging and disengaging the clamping element 23. The corresponding connections with the said drives for transmitting the control signals are indicated by broken lines. The connection may be designed as a wired or wireless connection, e.g., via radio, or as an optical connection. The roll change is carried out by means of the control means 24 automatically at least after the optionally manual insertion of the reserve roll R2 and removal of the old, e.g., used-up working roll R1. This applies to the flying roll change during running production and, according to the present invention, also to a roll change to be performed during the stoppage of the roll changer.

An automatic roll change during stoppage will be described below. The time sequence of the roll change during stoppage is shown in FIGS. 1 through 5.

FIG. 1 shows the roll changer with the working web A pulled in. The working web A wound off from the working roll R1 is first led over one of the deflecting rollers 9 and between the reserve roll R2 and the connecting means 10 to the tensioning and pulling means 16, it wraps around the cylindrical body 17 by about 140°, it is deflected directly behind the cylindrical body 17 by the deflecting roller 20 to the cylindrical body 22 of the holding means 21, it wraps around the cylindrical body 22 by preferably at least 90° and is finally led from there through the first printing gap of the printing press. In the state of the roll changer shown in FIG. 1, the working roll R1 is in a working position and the reserve roll R2 is in a joining or bonding position, from which they are pivoted farther together after the bonding into a working position for the current reserve roll and new working roll R2. The swivel warm 11 with the bonding roller 14 is in a starting position, in which the working web A is not touched, i.e., the working web A runs through free between the reserve roll R2 and the connecting means 10 in the state being shown. The cylindrical body 17 of the tensioning and pulling means 16 is held by the drive of the working roll R1 by means of the working web A, i.e., by the web tension of this working web, in a front position, in which the path of the web between the deflecting rollers 9 and 20 located closest to one another has its shortest length on both sides of the cylindrical body 17. The working web A is already fixed by the holding means 21 by the clamping element 23 being pressed with a pressing force against the cylindrical body 22 and by the web A being firmly clamped between the cylindrical body 22 and the clamping element 23, which preferably has an elastically non-rigid surface.

In the state of the roll changer shown in FIG. 1, the reserve roll R2 already assumes a defined rotation position. The reserve roll R2 was already rotated for this purpose into the pivoted position shown by means of the motor M2. The bonding site 6 was detected during this rotary movement by means of the sensor 7 and determined by the control means 24. After the detection of the bonding site 6 and the determination of the rotary position, the reserve roll R2 was rotated by means of the motor M2, controlled by the control means 24, into the rotation angle position shown with the rotation angle $\alpha$, and was preferably fixed in this rotary position. The rotation angle $\alpha$ defining this rotary position is the distance measured in degrees, at which the bonding site 6 is located from the pressing site of the bonding roller 14 when the bonding roller 14 is pressed against the reserve roll R2.

Figure 2:
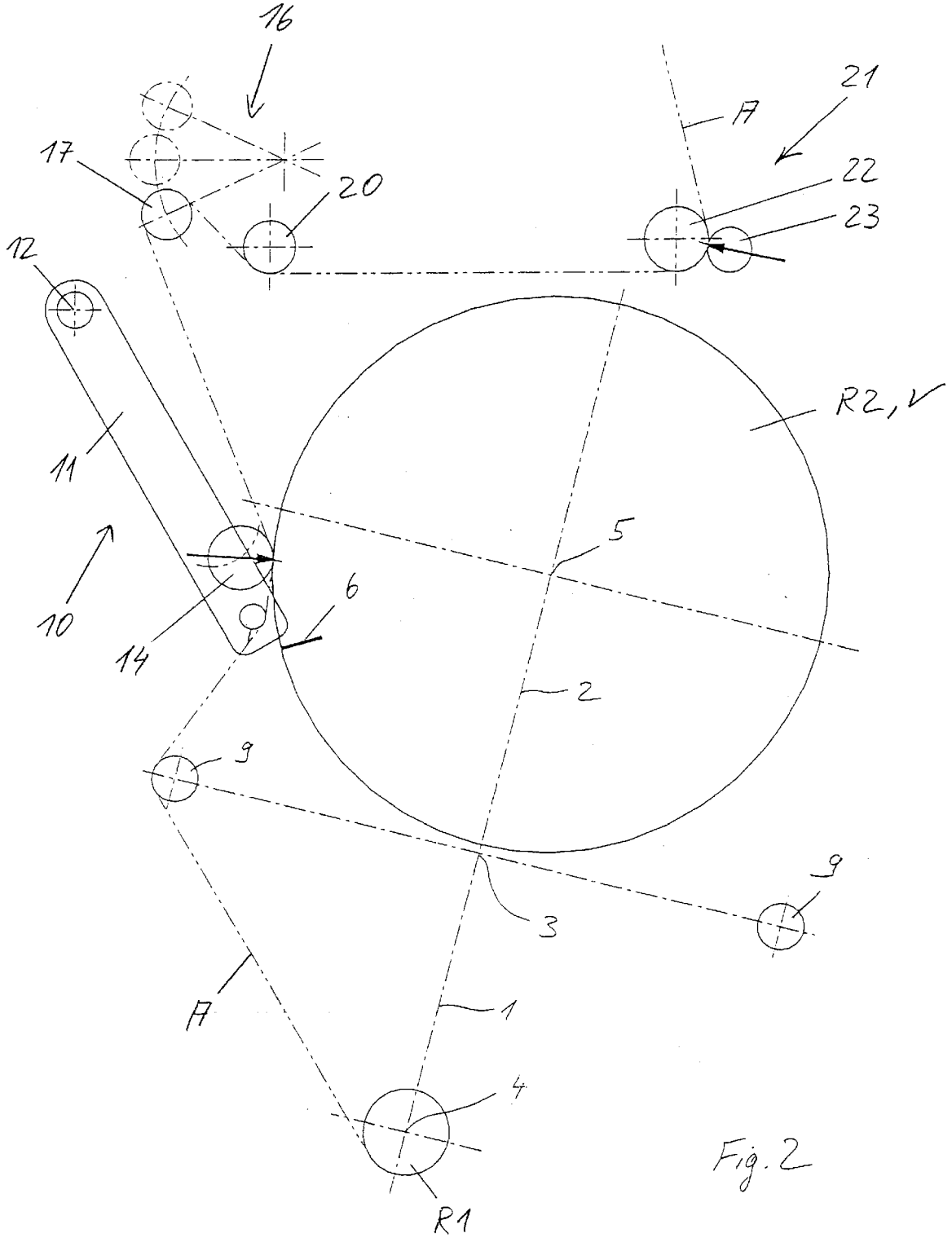
FIG. 2 is a schematic view showing the roll changer in a state in which a working web running off from the working roll is pressed onto the reserve roll.

FIG. 2 shows the state of the roll changer after the bonding roller 14 had been pivoted around the pivot axis 12 and engaged with the reserve roll R2 and is now pressed against the surface of the reserve roll R2. Otherwise, all other elements of the roll changer including the holding means 21 still assume the same positions as in the state shown in FIG. 1. The working roll R1 was possibly rotated slightly by the pressing on.

Figure 3:
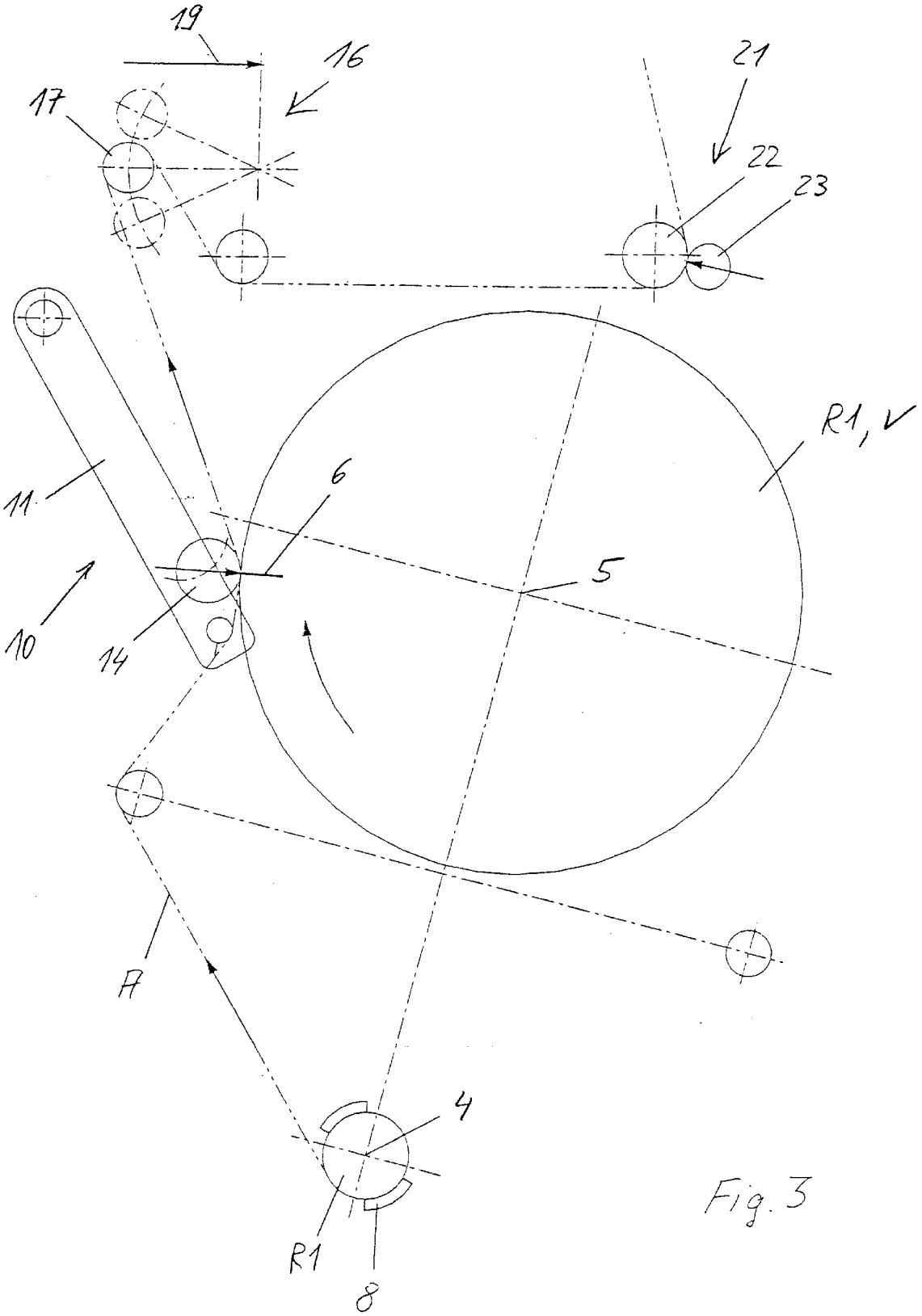
FIG. 3 is a schematic view showing the roll changer after the working web has been partially pulled out.

FIG. 3 shows the entire arrangement after the working web A has already been pulled off from the working roll R1 by a certain amount by means of the pulling means 16 compared with the state shown in FIG. 2. To apply the pulling force necessary for this to the working web A, the cylindrical body 17 was pivoted by the drive 19 around the pivot axis 18 and against the web tension into the middle desired position shown in FIG. 3. The cylindrical body 17 also assumes this desired position during running operation, but it pivots freely according to the cooperation of the web tension and the restoring element. The rotary movement of the working roll R1 is controlled by means of the motor M1 and/or a brake 8 during the pulling out of the working web A by the pivoting movement of the cylindrical body 17, which is brought about by means of the drive 19, such that a favorable web tension and pull-out speed become established. Especially preferably, an additional brake 8 is not needed now. The motor M1 is rather driven during the pulling out of the working web A with a defined speed of rotation or it even operates as a brake generator, and the drive 19 acts on the cylindrical body 17 with a defined restoring force, so that the cylindrical body 17 assumes the middle desired position. The pull-out movement of the working web A is indicated in FIG. 3 by two solid arrows in the path of the web.

Figure 4:
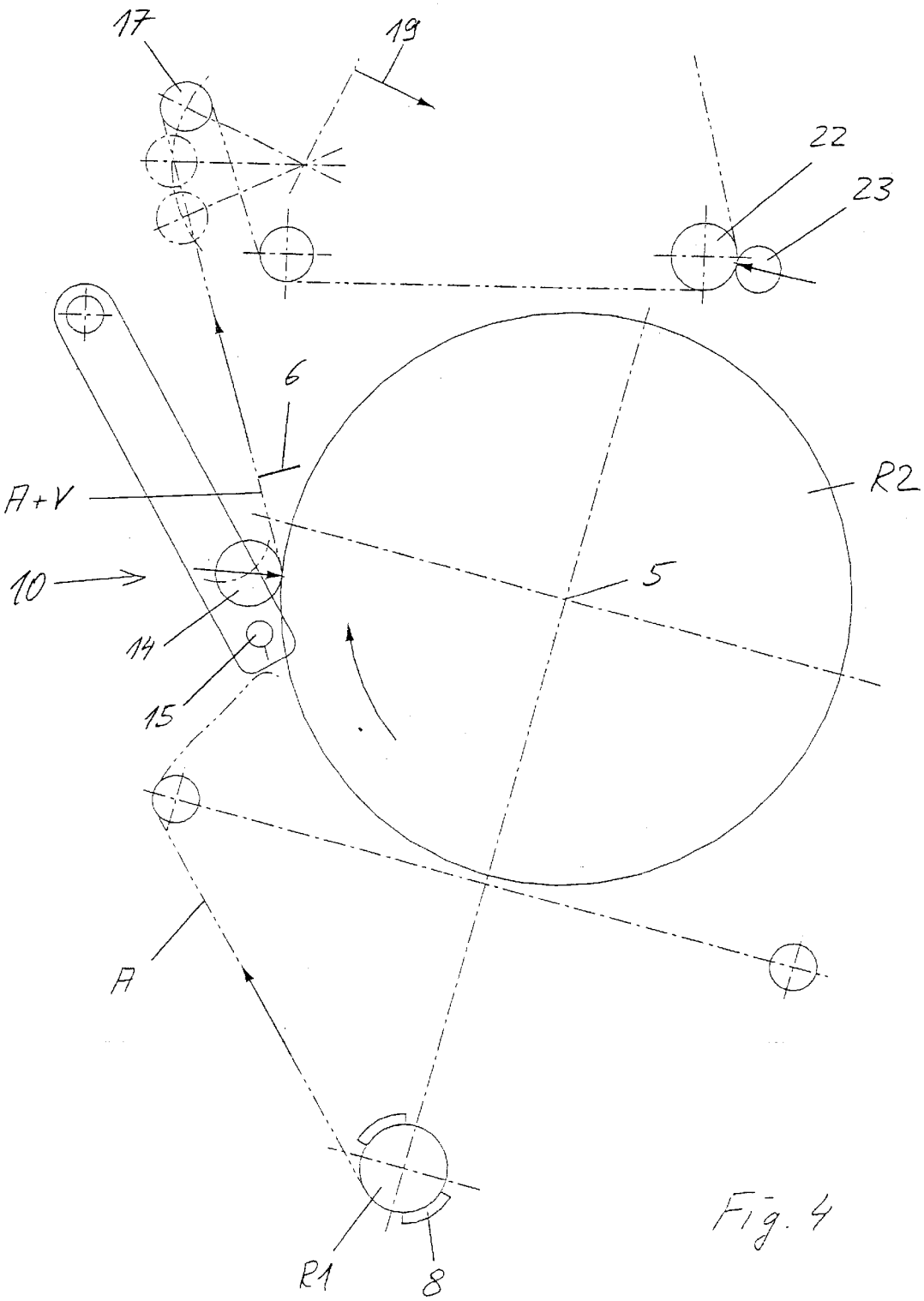
FIG. 4 is a schematic view showing the roll changer after the separation of a reserve web from the reserve roll.

Due to the frictional engagement brought about by means of the pressing bonding roller 14, the reserve roll R1 was rotated during the pull-out movement from its rotation angle position shown in FIGS. 1 and 2 into the rotary position shown in FIG. 3, in which the bonding site 6 comes to lie under the bonding roller 14. Since the bonding site 6 was already "focused" before, the working web A is pressed by the bonding roller 14 firmly against the beginning of the reserve web V having the bonding site 6 in the rotation angle position shown, and the beginning of the reserve web V is bonded to the working web A as a result. The braking force of the brake 8 is set by the control means 24, coordinated with the pivoting movement of the cylindrical body 17 of the pulling means 16. The coordination is such that the braking force of the brake 8 is set such that the cylinder 17 of the pulling means 16 performs a pivoting movement at a defined velocity into a rear position, which is indicated in FIG. 4 by a solid line. Instead of an additional brake 8, the motor M1 may be operated as a brake generator. In particular, one motor may form the motor M1 for both directions of rotation. Such a motor with reversible directions of rotation may also be designed additionally as a brake generator.

FIG. 4 shows in the sequence the state in which the cylindrical body 17 assumes its rear position and the working web A has therefore been pulled out by the maximum pull-out length within the framework of the roll change during stoppage. The bonding roller 14 is pressed against the reserve roll R2 during the entire operation, i.e., from the state shown in FIG. 2 to the state shown in FIG. 4. After the connection has been established, which takes place primarily in the state shown in FIG. 3, a clean separation of the beginning of the reserve web V from the reserve roll R2 is brought about by the bonding roller 14 continuing to be pressed on. In the state shown in FIG. 4, the beginning of the reserve web V is already separated from the reserve roll R2. After the separation of the beginning of the web, the working web A was, furthermore, also already cut off by means of the cutting knife 15 behind the bonding site 6, i.e., behind the bonding roller 14, which is even more preferred in the exemplary embodiment. FIG. 4 shows the old working web A immediately after the cutting off.

Figure 5:
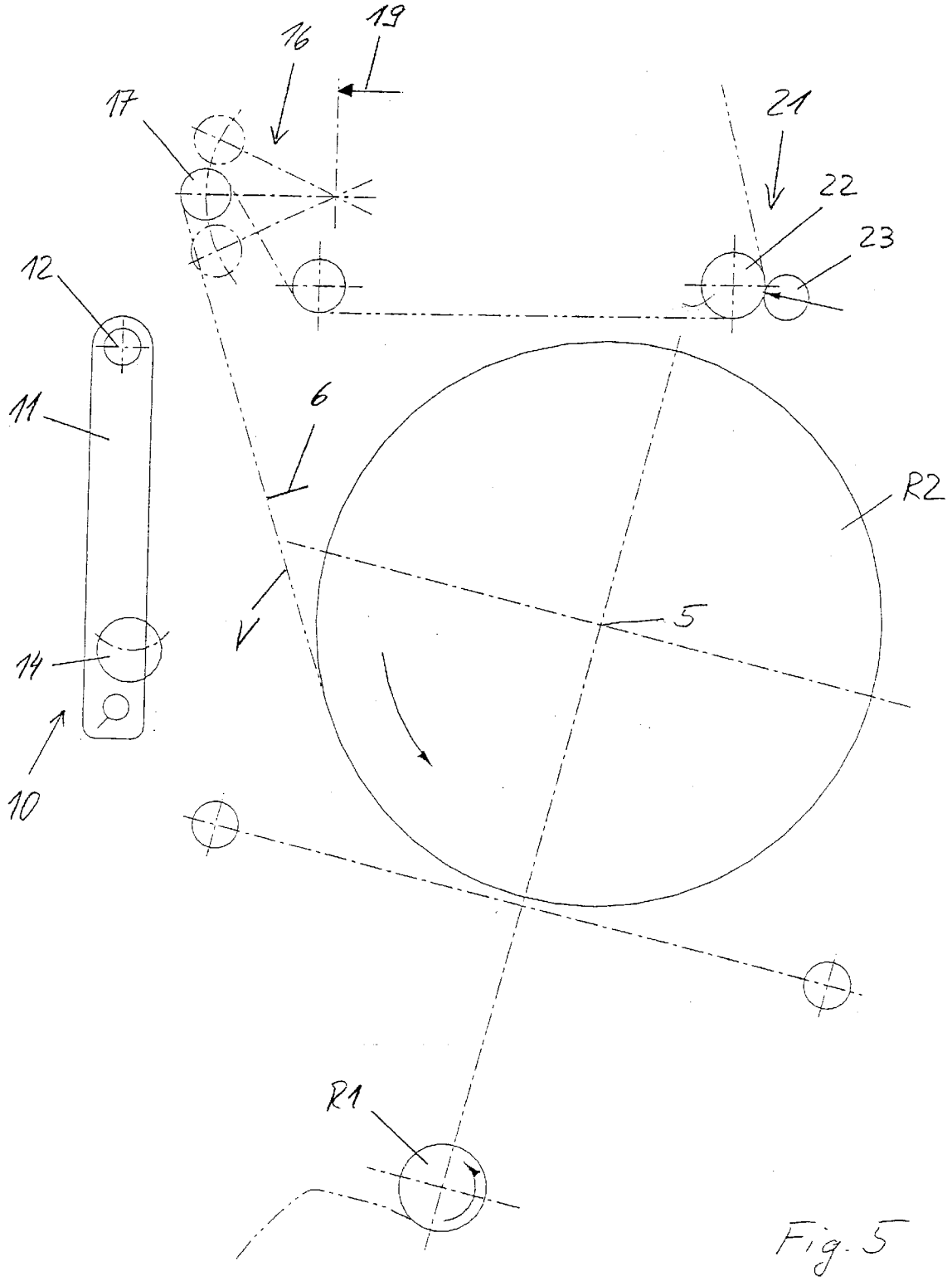
FIG. 5 is a schematic view showing the roll changer after the roll change.

The brake 8 is released after the cutting, and the working web A is again wound up to the cut beginning of the working web A on the working roll R1 by rotating back the working roll R1. This state is shown in FIG. 5. The old working roll R1 can be subsequently removed from the roll changer automatically or manually.

After the connection has been established and the beginning of the reserve web has been separated from the reserve roll R2, the connecting means 10 is again disengaged from the reserve roll R2. The cylindrical body 17 is subsequently moved by the drive M1 of the working roll R1 from its rear position shown in FIG. 4 back into the middle position (desired position), which the cylindrical body 17 will also assume during the later operation of the machine and around which it oscillates in the case of vibrations of the web. The working web A is continued to be fixed by the holding and pulling means 21 during this time. The reserve roll R2, from which the working web will be subsequently wound off, is rotated back during the return movement of the cylindrical body 10 into the middle position in order to maintain a constant or at least essentially constant web tension. The rotary return movement is indicated by the solid rotation arrow. The roll change is completed in this state shown in FIG. 5.

If the drive 19 is a pneumatic drive, it may also form the restoring element for the elastic compensation of vibrations of the web. However, if it has no elasticity, because it is formed, e.g., by a hydraulic drive or an electric drive, such a drive 19 is uncoupled for the purposes of web tension compensation during the operation of the machine.

To resume the production with the new working web formed by the reserve web, only the fixation between the cylindrical body 22 and the clamping element 23 must be eliminated by disengaging the clamping element 23.

While a specific embodiment of the invention has been shown and described in detail to illustrate the application of the principles of the invention, it will be understood that the invention may be embodied otherwise without departing from such principles.

What is claimed is:

1. A web-treating or processing machine roll changer set up to wind off a working web to be treated or processed from a working roll and for connecting a reserve web from a reserve roll to the working web, the roll changer comprising:

a first mount for the working roll;

a second mount for the reserve roll;

a connecting means for connecting the reserve web to the working web;

a holding means arranged downstream of said connecting means along the web for fixing the working web;

a pulling means arranged in a path of the working web between said connecting means and said holding means, said pulling means pulling said working web from the working roll and with said web held fixed by said holding means.

2. A roll changer in accordance with claim 1, wherein, said pulling means comprises a tensioning means compensating variations in the web tension during the running production of the machine.

3. A roll changer in accordance with claim 1, wherein said pulling means comprises at least one cylindrical body and a drive, said drive driving said cylindrical body to move at right angles to the working web in order to pull the working web from the working roll.

4. A roll changer in accordance with claim 3, wherein said cylindrical body is mounted movably at right angles to a longitudinal axis against a force of elasticity of a resetting means, wherein the force of elasticity counteracts a force that acts from the working web on said cylindrical body.

5. A roll changer in accordance with claim 4, wherein said cylindrical body comprises a dancing roller mounted movably at right angles to the working web.

6. A roll changer in accordance with claim 1, wherein said connecting means is arranged opposite the reserve roll and located in a joining position and is mounted such that it can be engaged with the reserve roll.

7. A roll changer in accordance with claim 1, wherein said holding means comprises a pulling element for feeding said working web.

8. A roll changer in accordance with claim 7, wherein said holding means comprises a clamping element that can be pressed against said pulling element for the fixation of said working web, which is brought about by clamping between said pulling element and said clamping element.

9. A roll changer in accordance with claim 1, wherein said holding means comprises a pulling means arranged in a path of said working web in front of a treating or processing means of the machine that closely follows the roll changer.

10. A roll changer in accordance with claim 1, wherein a motor for the rotating drive of said working roll comprises a brake generator.

11. A roll changer in accordance with claim 1, further comprising a motor or brake for stopping the working roll, the working roll being stopped during the pulling by said pulling means.

12. A process for automatic roll change in a web-treating or -processing machine, the process comprising the steps of:

moving a reserve roll of a reserve web into a joining position in relation to a working web, and pulling the working web into the machine and winding off from a working roll;

fixing the working web downstream from the beginning of the web of the reserve roll along the web;

pressing the fixed working web onto the beginning of the web of the reserve roll and connecting the working web to the beginning of the web of the reserve roll;

applying a pulling force to the fixed working web at a point between the beginning of the web of the reserve roll and the point of fixation, and the working web is pulled off from the working roll;

rotating the reserve roll during the pulling of the working web by pressing the working web or by using a separate drive;

severing the working web at a point between the working roll and the beginning of the web of the reserve roll after the connection has been established.

13. A process in accordance with claim 12, wherein the working web pressed onto the reserve roll is tensioned by braking and controlled drive of the working roll during the pulling off of the working web from the working roll.

14. A process in accordance with claim 12, wherein after the working web has been severed, the reserve roll is rotated back against the direction of feed of the reserve roll, the reserve roll then forming a new working web, while the fixation is still present, to tension the new working web.

15. A web roll changer for connecting a reserve web from a reserve roll to the working web being fed from a working roll, the roll changer comprising:

a first mount for the working roll;

a motor or brake for tensioning the pay out of the working web from the working roll on the first mount;

a second mount for the reserve roll;

a splicing connection means for connecting the reserve web to the working web;

a holding means arranged downstream of said connecting means along the web for fixing the working web;

a pulling means arranged in a path of the working web between said connecting means and said holding means, said pulling means pulling the working web from the working roll with the working web held fixed by said holding means and pulling said working web to pull the connected reserve web from the reserve roll and pulling said working web during the application of a tensioning force to said working roll via said motor or brake for tensioning the working web.

* * * * *